US011432638B2

(12) United States Patent
Delbove et al.

(10) Patent No.: US 11,432,638 B2
(45) Date of Patent: Sep. 6, 2022

(54) COSMETIC CASING COMPRISING A DEFORMABLE LATERAL WALL

(71) Applicant: L'OREAL, Paris (FR)

(72) Inventors: William Delbove, Clichy (FR); Jean-Marc Lebrand, Clichy (FR); Lionel Drugeon, Clichy (FR)

(73) Assignee: L'OREAL, Paris (FR)

( * ) Notice: Subject to any disclaimer, the term of this patent is extended or adjusted under 35 U.S.C. 154(b) by 362 days.

(21) Appl. No.: 16/335,025

(22) PCT Filed: Sep. 22, 2017

(86) PCT No.: PCT/EP2017/074110
§ 371 (c)(1),
(2) Date: Mar. 20, 2019

(87) PCT Pub. No.: WO2018/055122
PCT Pub. Date: Mar. 29, 2018

(65) Prior Publication Data

US 2019/0246770 A1 Aug. 15, 2019

(30) Foreign Application Priority Data

Sep. 23, 2016 (FR) ..... 1658966

(51) Int. Cl.
*A45D 40/22* (2006.01)
*A45D 33/00* (2006.01)
*A45D 33/22* (2006.01)

(52) U.S. Cl.
CPC ..... *A45D 40/222* (2013.01); *A45D 33/003* (2013.01); *A45D 33/22* (2013.01); *A45D 40/22* (2013.01); *A45D 2040/225* (2013.01); *A45D 2200/051* (2013.01); *A45D 2200/053* (2013.01)

(58) Field of Classification Search
CPC ..... A45D 2040/277; B65D 43/14–267; E05Y 2900/602
See application file for complete search history.

(56) References Cited

U.S. PATENT DOCUMENTS 4,586,519 A 5/1986 Seidler et al.
4,681,127 A * 7/1987 Gueret ..... A45D 40/22 132/301

(Continued)

FOREIGN PATENT DOCUMENTS

JP 10-304926 A 11/1998
WO WO 87/07483 A1 12/1987

OTHER PUBLICATIONS

International Search Report dated Nov. 8, 2017 in PCT/EP2017/074110 filed on Sep. 22, 2017.

(Continued)

*Primary Examiner* — Mollie Impink
(74) *Attorney, Agent, or Firm* — Oblon, McClelland, Maier & Neustadt, L.L.P.

(57) ABSTRACT

A device of axis X for packaging a cosmetic product, includes a base defining a storage compartment and a lid mounted movably in rotation on the base between a closed configuration of the device and an open configuration of the device, a receptacle being arranged in the storage compartment and the lateral wall of the receptacle includes an elastically deformable material.

12 Claims, 4 Drawing Sheets

(56) References Cited

U.S. PATENT DOCUMENTS

| | | | | |
|---|---|---|---|---|
| 5,896,866 | A * | 4/1999 | Quennessen | A45C 13/008 132/293 |
| 6,149,008 | A * | 11/2000 | Yuhara | A45D 33/006 206/581 |
| 2001/0017140 | A1 | 8/2001 | Petit | |
| 2006/0096611 | A1* | 5/2006 | Leppla | A45D 33/006 132/294 |

OTHER PUBLICATIONS

Japanese Office Action dated Jul. 6, 2020 in Patent Application No. 2019-515655.

Combined Chinese Office Action and Search Report dated Mar. 20, 2020 in corresponding Chinese Patent Application No. 201780058030.X (with English Translation of Category of Cited Documents), 8 pages.

* cited by examiner

Détail A

Détail B

Détail A

Détail A

COSMETIC CASING COMPRISING A DEFORMABLE LATERAL WALL

The invention relates to devices for packaging a cosmetic product, particularly make-up cases, for example for making up surfaces of the face such as the eyebrows, the cheekbones or the lips.

The make-up product is notably a foundation, a blusher, an eyeshadow, a lipstick, a lip gloss or a lip balm.

It is, in particular, in the form of a paste, gel or powder.

Within the meaning of the present invention, a "cosmetic product" is understood to be a cosmetic product designed to be applied to a human being, for example a solid, such as a powder, a liquid or a cream. A "cosmetic product" is more generally a product as defined in Regulation (EC) No 1223/2009 of the European Parliament and of the Council of 30 Nov. 2009 on cosmetic products.

According to the invention, the cosmetic product may be impregnated in a support, for example in a foam or a sponge.

Generally speaking, make-up cases include a lid and a case body that receives a reserve of product.

The product present in the case is likely to contain volatile solvents, and when the lid is closed the case must prevent these solvents evaporating, otherwise the product will be poorly preserved.

In the absence of solvents, when the product is a powder, for example, there is likewise an advantage in ensuring sealed closure in order to avoid the risk of product leaking out.

It has already been proposed in patent application EP-A-790 017 to guarantee the casing is sealed when the lid is closed by using a powder puff provided at its periphery with a bead that acts as sealing gasket. Sealing of this case is not, however, completely satisfactory.

Patent application WO1999/021454, also, proposed a case that includes a lid and a case body receiving a reserve of product contained in a cup, this case including a sealing gasket secured to the cup and pressed sealingly on the case body. In this instance likewise sealing of the case is not fully optimal.

Patent application WO2016/083607 discloses a cosmetics case comprising:

- a base defining within a storage compartment designed to receive a first cosmetic article,
- a plate mounted movably in rotation on the base on a first axis, said plate being movable between a closed configuration and an open configuration,
- a lid mounted movably in rotation on the base on a second axis, said lid being movable between a closed position, in which the lid covers the plate in the closed configuration, and an open configuration,
- a housing is provided in the plate and designed to receive a second cosmetic article, said housing comprising a bottom and a lateral wall capable of deforming elastically so as to increase in diameter though the effect of the bottom and the second axis being brought closer together.

Nevertheless, this device requires the mounting of an intermediate plate between the base and the lid in order to achieve sealing.

There is a need to propose devices for packaging a cosmetic product that have a simple structure and a reduced number of components and that are capable of providing better sealing.

There is also a need for a device that is inexpensive.

There is, further, a need for a device that is easy to use, takes up little space and makes it possible to carry out neat application.

There is, further, a need for a device that involves different body movements and a new sensation.

DEFINITION OF THE INVENTION

The invention relates to a device of axis X for packaging a cosmetic product, comprising a base defining a storage compartment and a lid mounted movably in rotation on the base about the axis Y of a hinge between a closed configuration of the device and an open configuration of the device, a receptacle of axis Z containing the product, delimited by a bottom and by a lateral wall, being arranged in the storage compartment, the axis Z of the receptacle being fixed relative to the base, the lateral wall of the receptacle comprises an elastically deformable material and the lateral wall enlarges through the effect of the base and the lid being brought closer together, forming a sealing gasket coming into contact with the lid in the closed configuration of the device.

By virtue of the lateral wall, the device of the invention offers a sprung effect upon taking up the formula, affording a pleasant sensation. The lateral wall slightly raises the lid when the device is opened in order to facilitate the user's body movements and for enhanced ergonomics.

The device takes up less space because it includes a minimum of components, in order to make it easier to carry and to hold in the hand.

The lateral wall plays a part in holding the receptacle in the closed position of the case. Assembly play may, if appropriate, be taken up, and greater manufacturing tolerances for the device may be allowed.

The lateral wall forms a peripheral sealing system around the cup in order to achieve:

sealing with less closure effort, a pop-up effect without a specific component, display of the formula, possibly by using a transparent lid.

A major advantage of the device according to the invention is the simplicity of its construction, which offers sealing that is as good as more complex devices, such as that of WO2016/083607.

A further subject of the invention is a cosmetic method comprising the steps consisting in:

(i) Providing a cosmetic device as described previously, (ii) Opening the lid in order to slacken off the lateral wall of the receptacle, (iii) Closing the lid in order to compress the lateral wall of the receptacle and to bring the lateral wall into contact with the lid.

Main Definitions

The "axis A" means the longitudinal axis A.

A "cross section of a component of axis A" is a section perpendicular to the axis A of the component.

"The lateral wall of the receptacle enlarges through the effect of the base and the lid being brought closer together" means that in cross section the mean maximum width of the receptacle increases upon closure of the lid.

"The lateral wall of the receptacle reduces in height through the effect of the base and the lid being brought closer together" means that the mean maximum height of the lateral wall, measured along the axis X, reduces upon closure of the lid.

Preferred Embodiments

Preferably, the device according to the invention has one or more of the following features, taken alone or in combination:

- the lateral wall of the receptacle has a closed contour having, in particular, a circular, oval or parallelepipedal cross section with corners defining an inwardly curved profile, particularly a triangular, rectangular or square section with corners defining an inwardly curved profile.

These forms are suited to a make-up case.

- The device comprises a closure device for holding the device in the closed configuration. Sealing is improved since closure is locked.
- The lid is transparent. The user can check the colour or degree of use of the product without opening the case.
- The device is designed for causing a pop-up effect upon opening.
- The receptacle is fastened in the storage compartment or is a refill.
- The lid is provided with an interior skirt capable of coming into contact with the elastically deformable lateral wall in the closed configuration of the device. This construction improves sealing of the device.
- The receptacle is formed by a cup connected by the lateral wall to a support piece. The contact between the product and the lateral wall is thus reduced, notably in order to avoid cracking of the product if it is solid.
- The receptacle is fastened to the base by clicking, snap-fitting, screwing or force-fitting. This fastening ensures that the receptacle is properly held in the base.

DESCRIPTION OF THE FIGURES

The invention will be better understood from reading the following detailed description of a non-limiting implementation example thereof, and with reference to the attached schematic and partial drawing, in which:

FIGS. 1 and 2 show a make-up case 10 of axis X, of circular cross section, including a base 11, a lid 12 and a receptacle 14.

Figure 1:
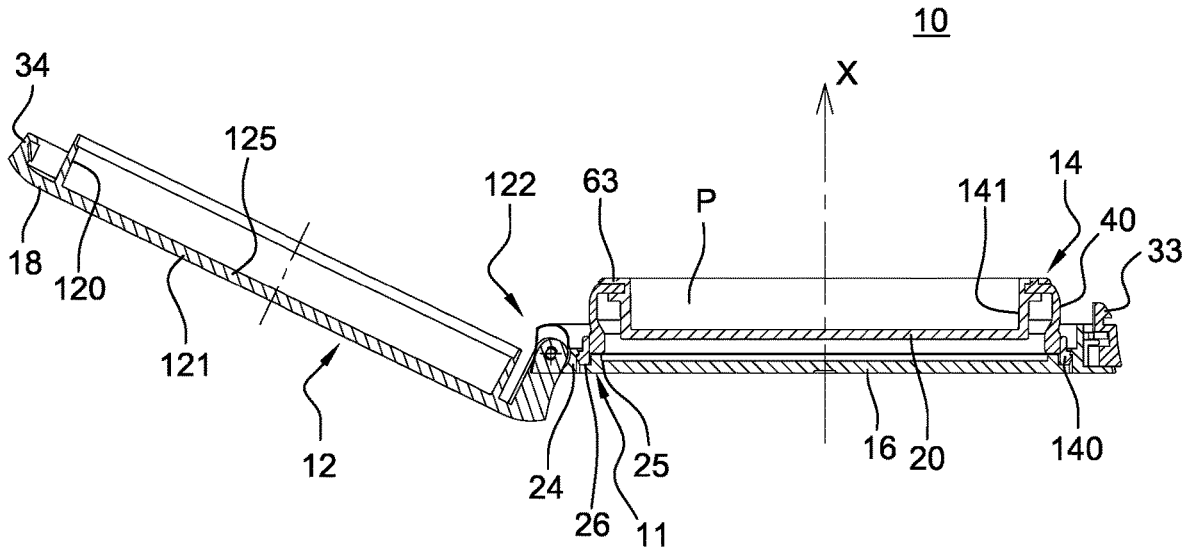
FIG. 1 is an axial section through a device according to the invention in the open configuration of the device.
Figure 2:
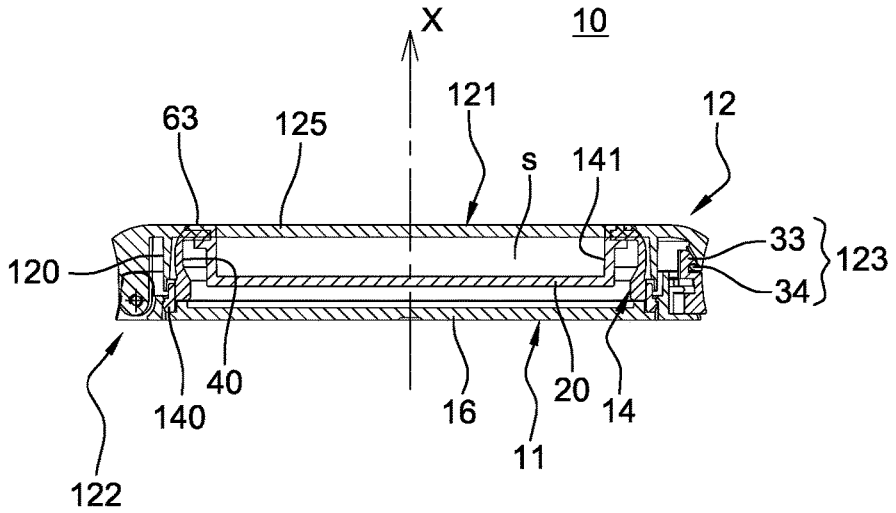
FIG. 2 is an axial section through the device in FIG. 1 in the closed configuration of the device.
Figure 3:
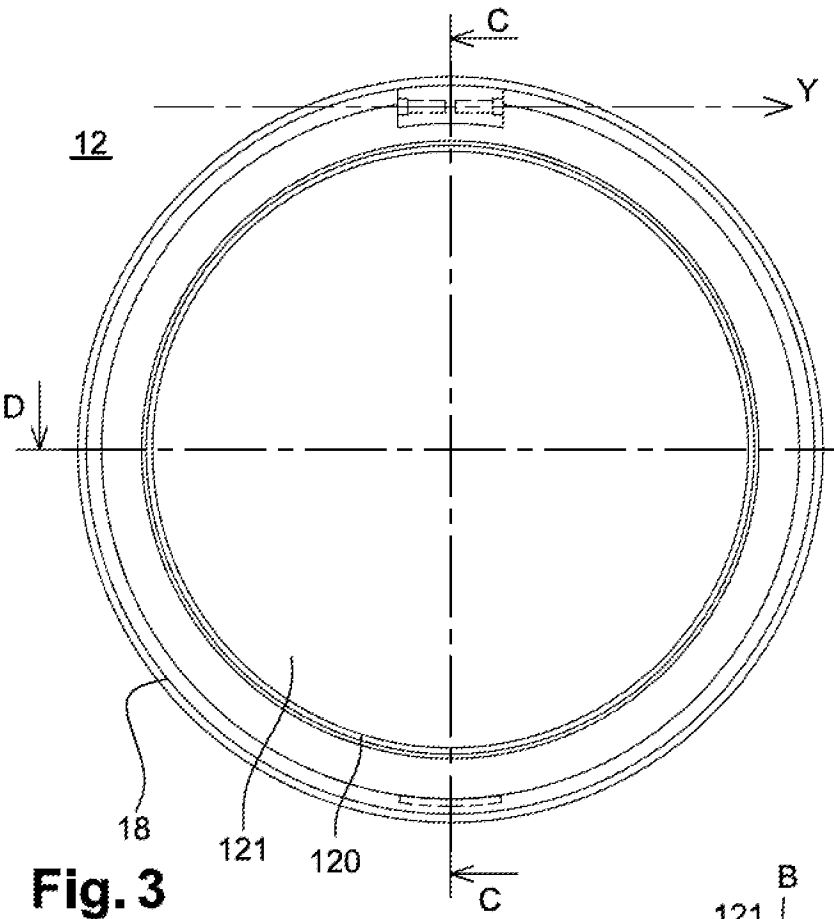
FIG. 3 is a top view of the lid of the device in FIG. 1.
Figure 4:
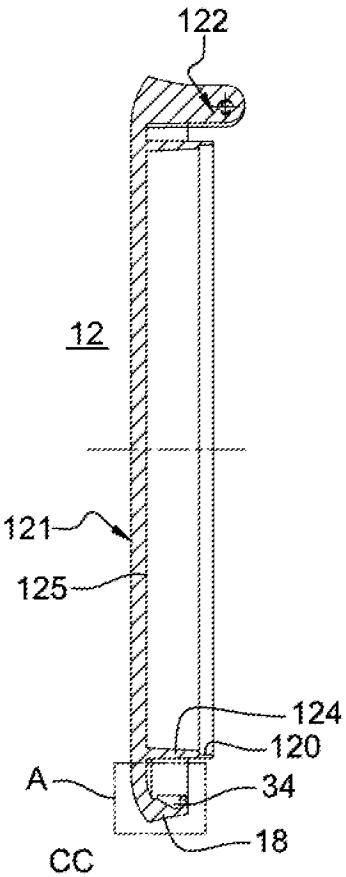
FIG. 4 is an axial section on the section line C-C in FIG. 3.
Figure 6:
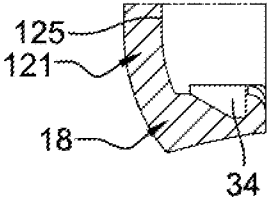
FIG. 6 shows detail A from FIG. 4.
Figure 7:
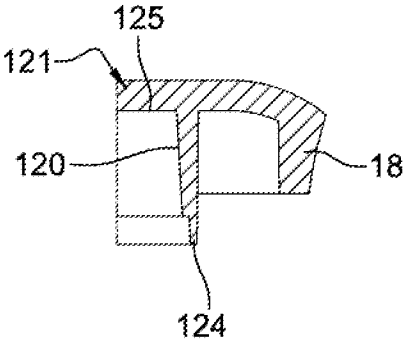
FIG. 7 shows detail B from FIG. 5.
Figure 5:
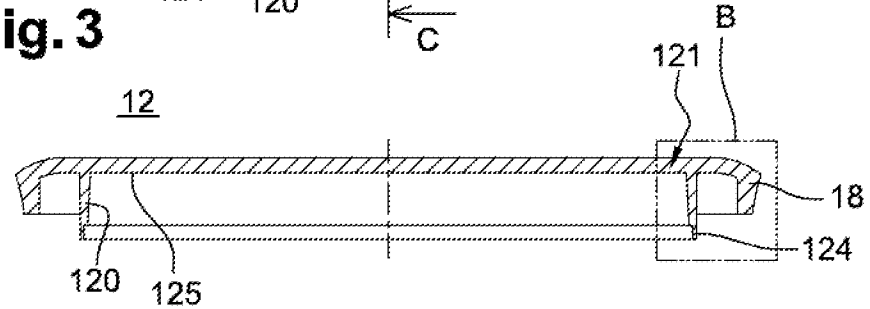
FIG. 5 is an axial section on the section line D-D in FIG. 3.
Figure 9:
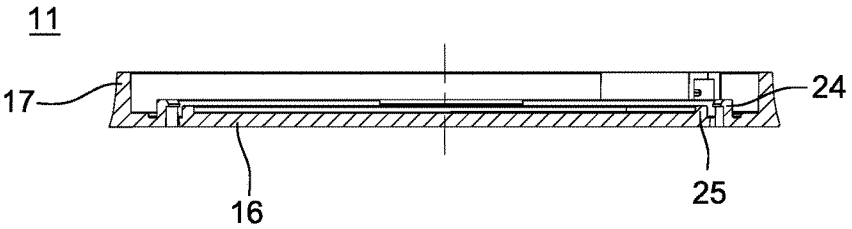
FIG. 9 is an axial section through the base on the section line D-D in FIG. 8.
Figure 11:
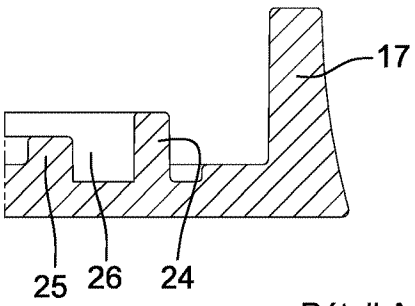
FIG. 11 shows detail A from FIG. 10.
Figure 10:
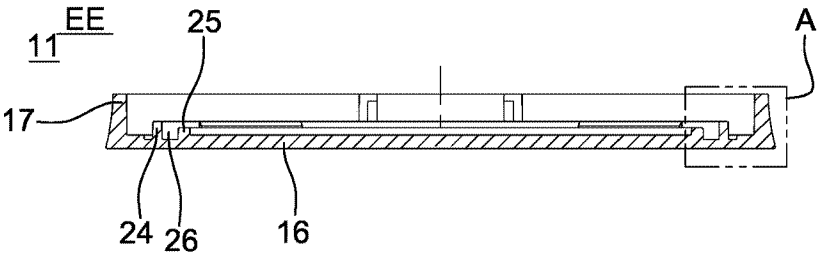
FIG. 10 is an axial section through the base on the section line E-E in FIG. 8.
Figure 8:
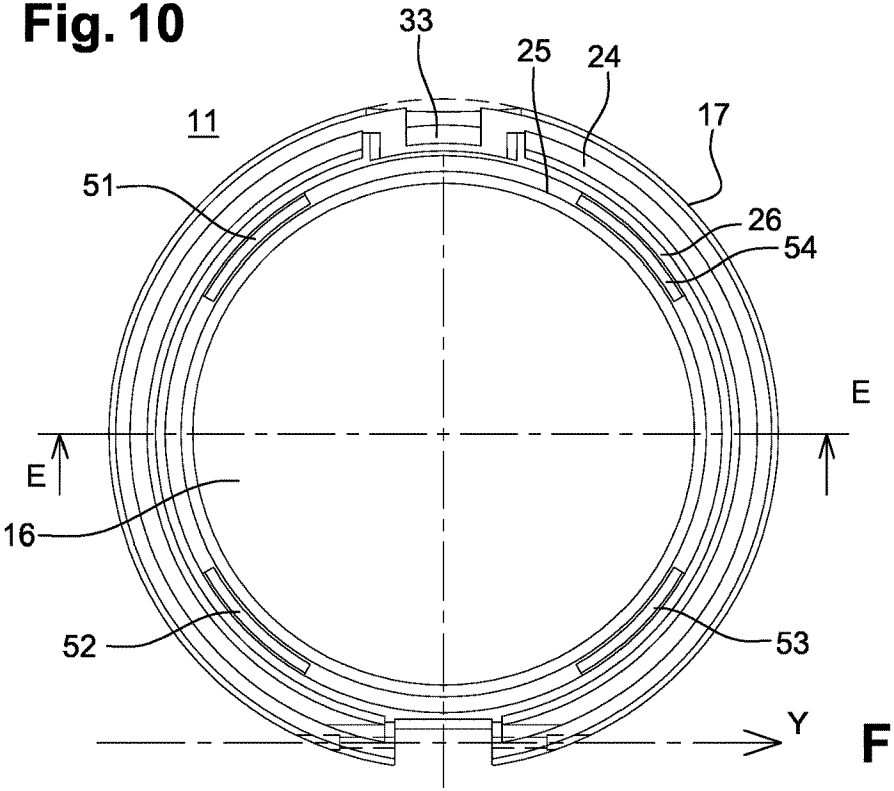
FIG. 8 is a top view of the base of the device in FIG. 1.

In the closed position of the case 10:

the diameter of the case is advantageously between 3 cm and 12 cm, and more preferably between 5 cm and 8 cm; the height of the case is advantageously between 0.7 cm and 2.5 cm, and more preferably between 1 cm and 2 cm.

The lid 12 is shown separately in FIGS. 3 to 7. It is articulated on the base 11 by means of a hinge 122 of axis Y. In the example described, it is produced in a colourless, translucent, filler-free plastics material. It is, for example, made with ABS or with PET/PETG.

It includes a top wall 122 delimited by a lateral edge 18 and extended at its periphery downwards by an annular rib 120, the cross section of which diminishes away from the internal face 125 of the wall 121 and ends in a free end forming a lip 124.

The base 11 is shown separately in FIGS. 8 to 11. It houses the receptacle 14 within. In the example described, it is made from ABS, but could be made from another material.

The base 11 has a bottom wall 16 and a cylindrical upright 17 surrounding, on the outside, two concentric axial ribs 24 and 25 that together define an annular groove 26. The bottom wall 16 is provided with four recesses 51, 52, 53, 54 of angular sector equal to 30° between the ribs 24 and 25.

The lid 12 is held in the closed position by the closure device 123 comprising a hook 33 located on the base 11 and engaging in the complementary recess 34 of the lid 12.

Figure 13:
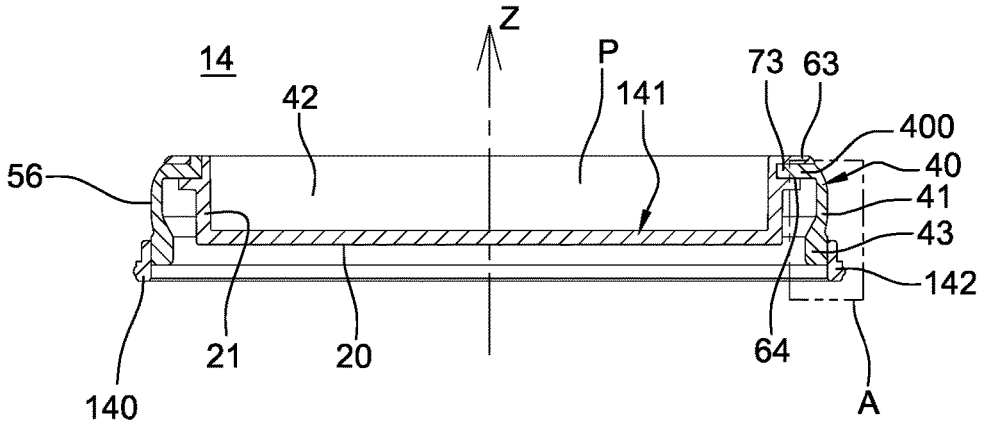
FIG. 13 is an axial section through the receptacle on the section line P-P in FIG. 12.
Figure 12:
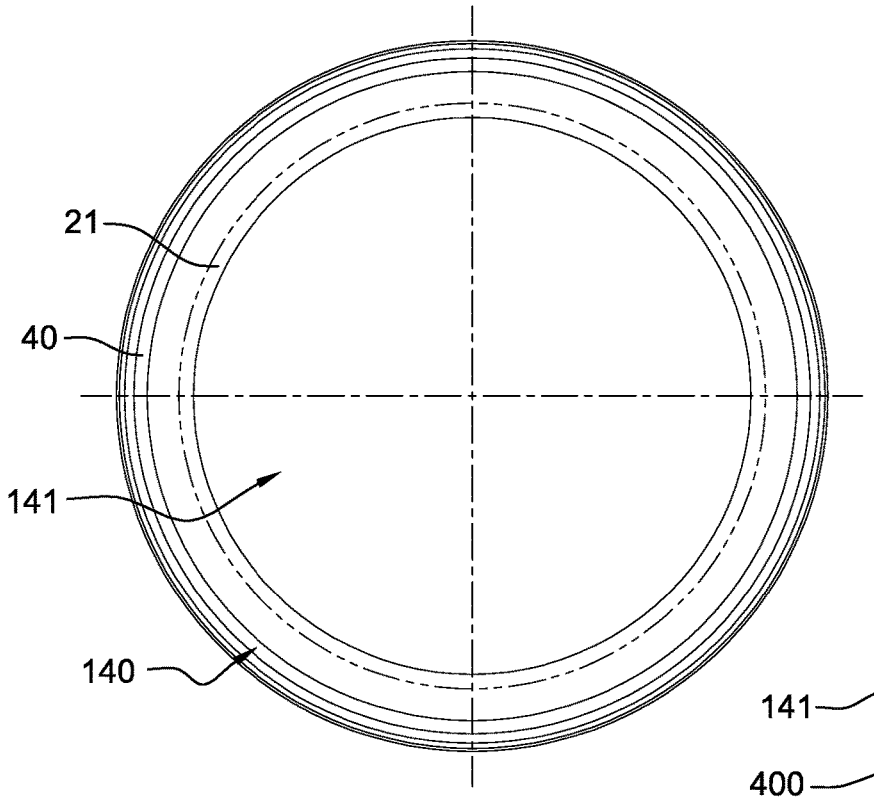
FIG. 12 is a top view of the receptacle of the device in FIG. 1.
Figure 14:
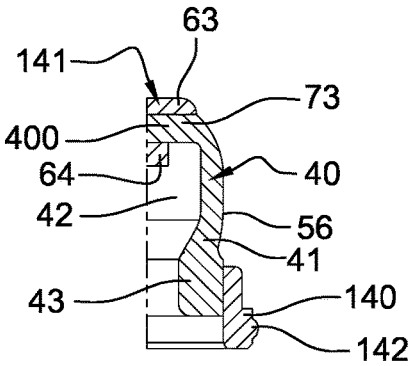
FIG. 14 shows detail A from FIG. 13.

The receptacle 14 of axis Z is shown in FIGS. 12 to 14. It is formed by the assembly of a cup 141, containing a product P, with a support piece 140 by means of a lateral wall 40.

The cup 141 includes a bottom wall 20 and a lateral upright 21 delimiting an interior space 42 of cylindrical form. The upright 21 ends in an edge 63 bearing on the internal face of the lid 12 in the closed configuration of the case. The edge 63 defines with the annular bead 64 an annular groove 73 for fastening the lateral wall 40.

This arrangement offers the advantage, in particular, of stiffening the upper part of the lateral wall 40, providing better behaviour over time and an improved rebound effect upon opening of the lid 12.

The side wall 40 is made, for example, from a thermoplastic elastomer such as SEBS, or a nitrile rubber (NBR), or a silicone.

In the embodiment shown, the wall 40 may be overmoulded on the support piece 140 and assembled with the cup 141.

The lateral wall 40 has a practically circular contour. However, other forms of contour may be envisaged, for example an oval or square contour.

As can be seen in FIGS. 13 and 14, the lateral wall 40 has a concave central portion 43, with the concavity facing the axis X. This form promotes the squashing of the lateral wall 40 and its enlargement in the opposite direction from the axis X upon closure of the lid 12, for improved sealing.

At its upper end, it ends in an edge 400 that inserts into the groove 73 and, at its lower end, a heel piece 43 affixed to a support piece 140. The latter forms an annular bearing structure extended outward at the bottom by a peripheral bead 142 that clicks into the groove 26 of the base 11.

In the example described, the lateral wall 40 is produced as a single piece. It is squashed, increasing in diameter and reducing in height through the effect of the lid 12 and the base 11 being brought closer together.

In the closed configuration, an external surface 56 of the lateral wall 40 enters into contact with the internal wall 125 of the lid 12 in order to form a sealing gasket closing the cup 141. The annular rib 120 of the lid 12 bears against the external surface 56 in order to further promote better sealing.

In the open position of the lid, the height of the lateral wall is, for example, 8.1 cm and its width 5.4 cm. In the closed position of the lid, the height of the lateral wall is, for example, 6.7 cm and its width 7.1 cm.

To close the case, the use seizes the lid 12 and brings it closer to the base 11. This movement causes squashing of the lateral wall 40 until a sealed contact is formed with the lid 12, when the lateral wall 40 is gripped between the base and the lid.

In a single movement the user is thus able to form a sealed contact between the base 11 and the lid 12 and to place the case 10 in the closed configuration.

In the closed position, the lid 12 exerts a uniform pressure on the sealing gasket. This uniformity of pressure is promoted by the action of the closure device 123.

No product leaks out of the case, irrespective of the position of the actual device 10. The case 10 always remains clean and easy to carry.

Conversely, in order to open the case starting from the closed position of the lid, the user actuates the closure device 123 in order to release the hook 33 from the recess 34.

Once the lid 12 has been unlocked, the decompression of the lateral wall 40 tends to raise the lid 12 towards its open configuration. The lid 12 and the base 11 thus part more easily from one another, and the effort provided by the user to lift the lid is reduced.

Preferably, with the exception of the lateral wall 40, the different elements forming the case are made by injection-moulding of a thermplastics material of polymer type, such as acrylonitrile butadiene styrene (ABS), styrene acrylonitrile (SAN) or a polypropylene.

Of course, the invention is not limited to the exemplary embodiment just described.

The invention applies, in particular, to any form of case and to any structure of receptacle.

The invention claimed is:

1. A device for packaging a cosmetic product, comprising:

a base defining a storage compartment, the base having a central axis;

a lid mounted movably in rotation on the base about an axis of a hinge between a closed configuration of the device and an open configuration of the device; and a receptacle containing the product P, delimited by a bottom, an upright wall, and by a lateral wall having a concave central portion, being arranged in the storage compartment, the receptacle being fixed relative to the base, wherein the lateral wall of the receptacle comprises an elastically deformable material and a width of the lateral wall is configured to increase through the effect of the base and the lid being brought closer together, forming a sealing gasket coming into contact with the lid in the closed configuration of the device, wherein in the closed configuration, an internal wall of the lid contacts an external surface of the lateral wall, wherein the concave central portion is located on an internal portion of the lateral wall that faces in a direction of the central axis of the base, wherein the upright wall defines a groove at an upper end of the upright wall, and wherein the lateral wall includes an upper edge positioned within the groove of the upright wall.

2. The device according to claim 1, wherein the lateral wall of the receptacle is a continuous solid wall having a circular, oval or parallelepipedal cross section with corners defining an inwardly curved profile.

3. The device according to claim 1, further comprising: a closure device for holding the device in the closed configuration.

4. The device according to claim 1, wherein the lid is transparent.

5. The device according to claim 1, wherein the device is configured to cause a pop-up effect upon opening.

6. The device according to claim 1, wherein the receptacle is fastened in the storage compartment or is a refill.

7. The device according to claim 1, wherein the lid is provided with an interior skirt capable of coming into contact with the lateral wall in the closed configuration of the device.

8. The device according to claim 1, wherein the receptacle is formed by a cup connected by the lateral wall to a support piece.

9. The device according to claim 1, wherein the receptacle is fastened to the base by clicking, snap-fitting, screwing or force-fitting.

10. The device according to claim 1, wherein the product is a foundation, a face-care product, a blusher, an eyeshadow, a lipstick, a lip gloss or a lip balm.

11. The device according to claim 1, wherein the lateral wall of the receptacle is a continuous sold wall having a triangular, rectangular or square section, and wherein corners of the receptacle define an inwardly curved profile.

12. A cosmetic method comprising the steps consisting in:

(i) providing a cosmetic device according to claim 1, (ii) opening the lid in order to slacken off the lateral wall of the receptacle, and (iii) closing the lid in order to compress the lateral wall of the receptacle and to bring the lateral wall into contact with the lid.

* * * * *